US006282396B1

(12) United States Patent
Iwata et al.

(10) Patent No.: US 6,282,396 B1
(45) Date of Patent: Aug. 28, 2001

(54) COLOR IMAGE FORMING APPARATUS AND METHOD OF OBTAINING COLOR IMAGES WITH DECREASED IMAGE POSITIONAL DEVIATION

(75) Inventors: Nobuo Iwata, Sagamihara; Mitsugu Sugiyama; Toshiya Satoh, both of Yokohama; Tadashi Shinohara, Tokyo; Yutaka Shio; Tomonori Yabuta, both of Yokohama, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/617,243

(22) Filed: Jul. 14, 2000

Related U.S. Application Data

(63) Continuation of application No. 08/972,413, filed on Nov. 18, 1997, now Pat. No. 6,128,459.

(30) Foreign Application Priority Data

Nov. 18, 1996 (JP) ..... 8-306569
Jan. 20, 1997 (JP) ..... 9-007746

(51) Int. Cl.[7] ..... G03G 15/01
(52) U.S. Cl. ..... 399/301; 347/116
(58) Field of Search ..... 399/301; 347/116; 430/44

(56) References Cited

U.S. PATENT DOCUMENTS 5,384,592 * 1/1995 Wong ..... 347/116
5,828,926 10/1998 Iwata et al. .
5,854,958 * 12/1998 Tanimoto et al. ..... 399/301

FOREIGN PATENT DOCUMENTS 6-18796 * 1/1994 (JP) .
6-118735 * 4/1994 (JP) .

* cited by examiner

*Primary Examiner*—William J. Royer
(74) *Attorney, Agent, or Firm*—Oblon, Spivak, McClelland, Maier & Neustadt, P.C.

(57) ABSTRACT

An apparatus and method of forming a color image on a recording sheet by transferring respective images onto a single recording sheet conveyed by a conveying belt, where the combination of the respective images form the color image. The respective color images are formed with a plurality of electrophotographic processing sections disposed along the conveying belt such that the respective color images are superimposed on one another to make the color image. The electrophotographic processing sections also form more than two colors, of a same pattern, of image positional deviation detecting marks. The image positional deviation detecting marks include a line in a main scanning direction and another line positioned at an incline with respect to the former line in order on the conveying belt. A detector is included that detects the image positional deviation detecting mark with a single detecting device composed of a light source, a slit, and a light accepting element.

8 Claims, 13 Drawing Sheets

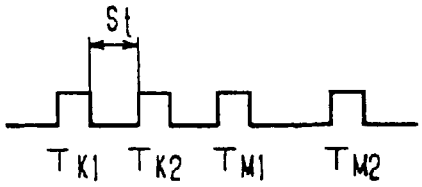
Fig. 14
Fig. 15(a)
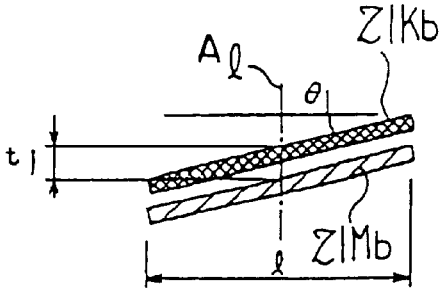
Fig. 15(b)
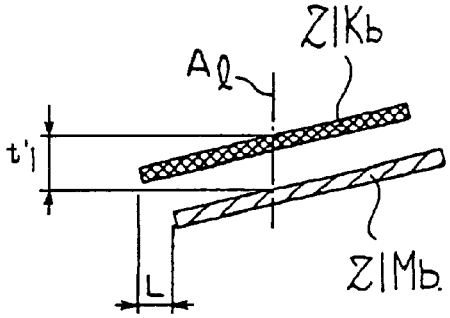

COLOR IMAGE FORMING APPARATUS AND METHOD OF OBTAINING COLOR IMAGES WITH DECREASED IMAGE POSITIONAL DEVIATION

This application is a continuation of application Ser. No. 08/972,413 Filed on Nov. 18, 1997, now U.S. Pat. No. 6,128,459.

BACKGROUND OF THE INVENTION

1. Field of the Invention

The present invention relates to a color image forming apparatus and method of forming a color image using an electrophotographic process.

2. Discussion of the Background

A so-called tandem-type method is used in a color image forming apparatus in which a color image is obtained by transferring by superposition respective color images formed with an electrophotographic processing section of the apparatus onto a recording sheet.

FIG. 1 is a side view of a color image forming apparatus of the tandem-type method. As shown in FIG. 1, a sheet conveying path 4 is provided for guiding a transfer sheet 1, as a recording sheet, from a sheet feeding section 2 through a sheet discharging section 3 in the color image forming apparatus. The sheet conveying path 4 includes a conveying belt 7 that is movably positioned between a belt drive roller 5 that is rotated by drive power from a drive power source (not shown) and a belt driven roller 6 coupled to the drive power source. Further, on the conveying belt 7, four electrophotographic processing sections 8Y, 8M, 8C, and 8K, for yellow, magenta, cyan, and black are respectively disposed in order. These electrophotographic processing sections respectively include a photoconductive drum 9, as a photoconductive element, that contacts the conveying belt 7, as well as a charging device 10, an exposing device 11, a developing device 12, a transferring device 13, and a photoconductive element cleaner 14 each being disposed in order around the photoconductive element 9. In addition, the conveying path 4 is provided with a fixing unit 15 at a position just after the conveying belt 7, as shown.

Typically, the color image forming apparatus that has such a construction feeds an uppermost transfer sheet 1 from a sheet feeding section 2 towards the sheet conveying path 4, and is conveyed with the conveying belt 7. During the sheet conveying process, an image forming operation for each of the four colors is performed by each electrophotographic processing section, using electrophotographic processes, i.e., charging, exposing, developing, and transferring processes. A color toner image is transferred onto the transfer sheet 1, and fixed thereon by being heated and pressed with the fixing unit 15. This is a principle of image forming by the color image forming apparatus of the tandem-type method as shown in FIG. 1.

FIG. 2 illustrates from a perspective view the conveying belt 7 and respective drums 9. As will be discussed herein, a main scanning direction is indicated by a mark B, and a sub-scanning direction is indicated by a mark C.

Even though the color image forming apparatus of the tandem-type method has an advantage of high printing speed, the present inventors recognized that this conventional apparatus has a shortcoming in that an alignment of each of the colors is difficult to achieve and maintain. Therefore, for example, a slight positional deviation often occurs when a user or a service engineer moves a part of the electrophotographic processing section from a proper position when removing a jammed sheet or repairing the apparatus, and this slight positional deviation causes a color deviation between the respective colors.

Several approaches to preventing the color image positional deviation have been proposed in recent years.

For example, as discussed in reference to FIGS. 3 and 4, an image positional deviation detecting method is disclosed in Japanese Laid-Open Patent Publication NO. 6-18796/1994. Image positional deviation detecting sensors 102, which include two CCD line sensors 101 (in FIG. 4), are positioned so as to face the conveying belt 7. Image positional deviation detecting marks 103 are formed on the conveying belt 7 by the electrophotographic processing section before the image forming operation is performed. The detecting marks 103 are positioned in areas where the CCD line sensors 101 can read them such that an amount of image positional deviation corresponding to the electrophotographic processing sections 8Y, 8M, 8C, and 8K can then be detected by reading the positional deviation detecting marks 103 by the CCD line sensors 101 as shown in FIG. 3. The image positional deviation detecting sensor 102 includes a light source 104 and a light collecting lens 105 for collecting and providing reflection light to the CCD line sensor 101, reflected by the conveying belt 7, which is emitted from the light source 104 as shown in FIG. 4.

However, as presently recognized, the image positional deviation detecting method disclosed in Japanese Laid-Open Patent Publication No. 6-18796/1994 has some problems in that parts costs are greater than desired due to the inclusion of the expensive CCD line sensor 101 or light collecting lens 105. Furthermore, focusing of the reflection light from the conveying belt 7 must be adjusted by the light collecting lens 105, and therefore the successful operation of the apparatus becomes troublesome.

In reference to FIGS. 5 through 8(*b*), and in light of the limitations of the above-mentioned method, a device is described in Japanese Laid-Open Patent Publication No. 6-118735/1994 as detecting the color image positional deviation using an inexpensive reflection-type optical sensor 204 composed of a light source 201, and a slit 202, and a light accepting element 203. Namely, V-shaped image positional deviation detecting marks 205 are formed on the conveying belt 7, and a leading edge and a trailing edge thereof are detected with two reflection-type optical sensors 204, as shown in FIG. 6. For example, in the case of detecting the image positional deviation between a black electrophotographic processing section 8K (FIG. 1) and a magenta electrophotographic processing section 8M (FIG. 1), two black lines K1 and K2 which compose each edge of the first V-shaped mark, two magenta lines M1 and M2 which compose each edge of the second V-shaped mark, a black line K3 which composes one edge of the third V-shaped mark, and a magenta line M3 which composes another edge of the third V-shaped mark are formed on the conveying belt 7, as shown.

FIG. 7 shows an example in which the magenta electrophotographic processing section 8M deviates in a sub-scanning direction. Namely, when the image positional deviation detecting mark 205 is detected with respective reflection-type optical sensors 204, an output signal from one side of the reflection-type optical sensor 204*a* (lower part of FIG. 7) is represented in FIG. 8(*a*), and another side of the reflection-type optical sensor 204*b* (upper part of FIG. 7) is represented by a diagram in FIG. 8(*b*). Thus, if a time difference between pulses based on a signal of one side reflection-type optical sensor 204 is not constant {FIG. 8(*a*)}, and a time difference between pulses based on a signal of another side reflection-type optical sensor 204 is constant {FIG. 8(*b*)}, an electrophotographic processing section of a certain color is judged to have deviated in a sub-scanning direction.

In light of the above description regarding deviation in the subscanning direction, it is possible for deviations to occur in the main scanning direction. More particularly, when an electrophotographic processing section of a certain color deviates in position along the main scanning direction, the timing of output signals from two reflection-type optical sensors 204*a*, 204*b* deviates. For example, if the image positional deviation detecting mark 205, composed of two black lines K1 and K2 which construct each edge of the first V-shaped mark, deviates upwards, it is assumed that a pulse based on the output signal of the reflection-type optical sensor 204*b* {FIG. 8(*b*)} precedes a pulse based on the output signal of the reflection type optical sensor 204*a* {FIG. 8(*a*)}. Therefore, the image positional deviation in the main scanning direction of the electrophotographic processing section can be detected by detecting the output pulse timing of the respective reflection-type optical sensors 204*a*, 204*b*.

Since the invention disclosed in Japanese Laid-Open Patent Publication No. 6-118735/1994 has a construction which detects the image positional deviation detecting mark 205 using the inexpensive reflection-type optical sensor 204 composed of the light source 201, the slit 202, and the light accepting element 203, the parts costs are much less than the apparatus disclosed in Japanese Laid-Open Patent Publication No. 6-18796/1994.

However, in accordance with a detection aspect of the apparatus disclosed in Japanese Laid-Open Patent Publication No. 6-118735/1994, two reflection-type optical sensors 204 are required, and therefore, the parts cost is greater than that for an apparatus requiring a single detector, and the construction thereof becomes complicated due to the need to secure enough space for mounting the two reflection-type optical sensors 204.

Further, since the image positional deviation detecting mark 205 is formed on the conveying belt 7 with an electrophotographic process, toner is randomly scattered at an edge part E of the image positional deviation detecting mark 205. As shown in FIG. 9, this scattering of toner gives rise to a problem in that a sharply contrasted output signal cannot be obtained by the reflection-type optical sensor 204. Namely, an output waveform from the reflection-type optical sensor 204 has a gentle slope as shown in FIG. 10 which increases the difficulty of detecting a leading edge and a trailing edge of the mark 205.

SUMMARY OF THE INVENTION

In view of the above-mentioned considerations, it is an object of the present invention to provide a color image forming apparatus capable of decreasing image positional deviation and overcoming the above-described limitations of conventional methods and apparatuses.

This and other objects may be obtained with an apparatus and a method of forming a color image on a recording sheet that is attained by transferring respective images formed with a plurality of photographic processing sections disposed along a conveying belt, on which the respective images are superimposed in order and subsequently onto the single recording sheet conveyed with the conveying belt. More than two colors of a same pattern of image positional deviation detecting marks are formed and include a line in a main scanning direction and another line positioned, inclining to the former line, in order on the conveying belt by operating at least two of the electrophotographic processing sections.

An image positional deviation detecting mark formed on the conveying belt is detected with a single detecting device composed of a light source, a slit, and a light accepting element. The slit is constructed with a combination of slits that are oriented parallel with each other and provided with approximately a same width as that of the image positional deviation detecting mark.

BRIEF DESCRIPTION OF THE DRAWINGS

A more complete appreciation of the invention and the attendant advantages thereof will be readily obtained by referring to the following detailed description when considered in connection with the accompanying drawings, wherein:

FIG. 14 is a timing diagram showing an example time occurrence of a mark signal based on the detecting signal of the detecting device (reflection-type optical detecting sensor);

FIGS. 15(*a*) and 15(*b*) are top views showing respective relationships of respective parts of the mark when the slanting angle of the slanting line which composes the image positional deviation detecting mark is relatively small;

DESCRIPTION OF THE PREFERRED EMBODIMENTS

Figure 5:
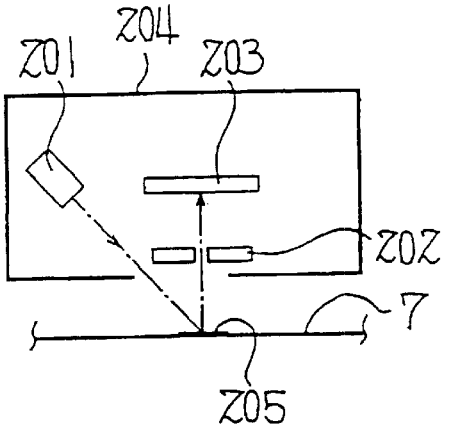
Fig.5 prior art
FIG. 5 is a vertical sectional side view of the reflection-type optical sensor.
Figure 6:
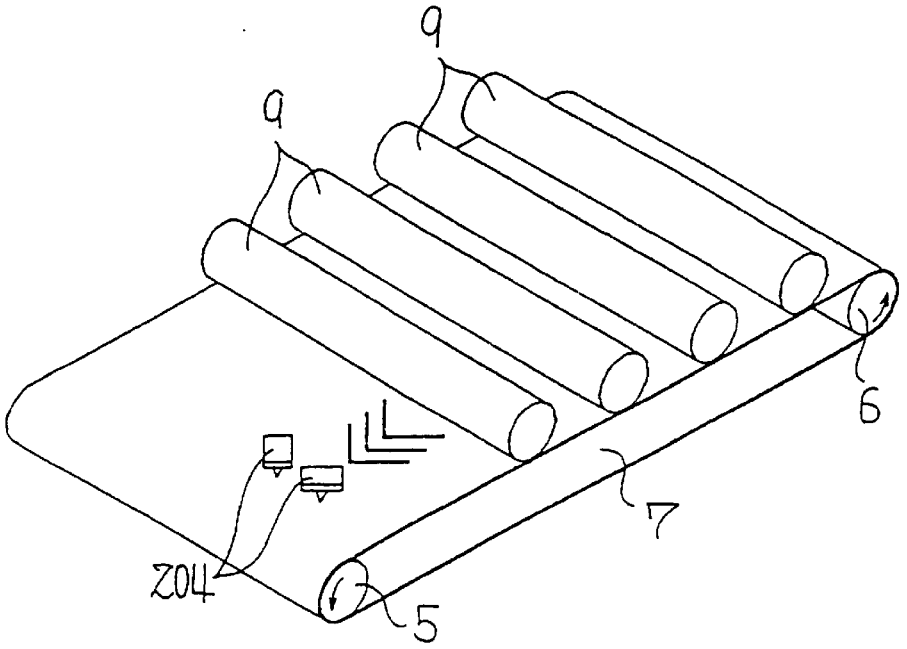
Fig. 6 prior art
FIG. 6 is a perspective view showing the conveying belt, the photoconductive element, and a detecting sensor of another prior-art apparatus for experimenting with a color deviation preventing method.
Figure 7:
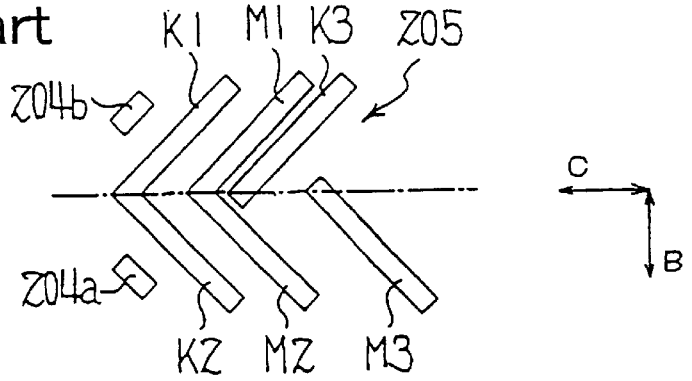
Fig. 7 prior art
FIG. 7 is a top view showing an image positional deviation detecting mark formed on the conveying belt.
Figure 8:
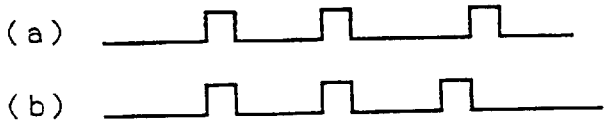
Fig. 8 prior art
FIGS. 8*a* and 8*b* are timing charts showing pulse signals based on output signals of the reflection-type optical sensors, which is read from the image positional deviation detecting mark.
Figure 9:
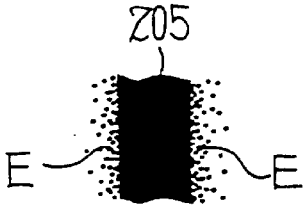
Fig. 9 prior art
FIG. 9 is an enlarged top view showing a portion of the image positional deviation detecting mark.
Figure 10:
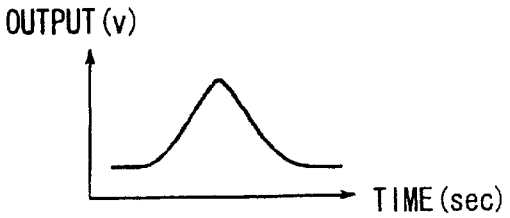
Fig. 10 prior art
FIG. 10 is a diagram showing an output signal of the reflection-type optical sensor that is read from the image positional deviation mark.

A first embodiment of the present invention is explained in reference to FIGS. 11 through 17(*b*). Because common reference numerals represent the same elements previously explained in reference to FIGS. 1, 2, and 5, further explanation of these common elements is omitted.

Figure 1:
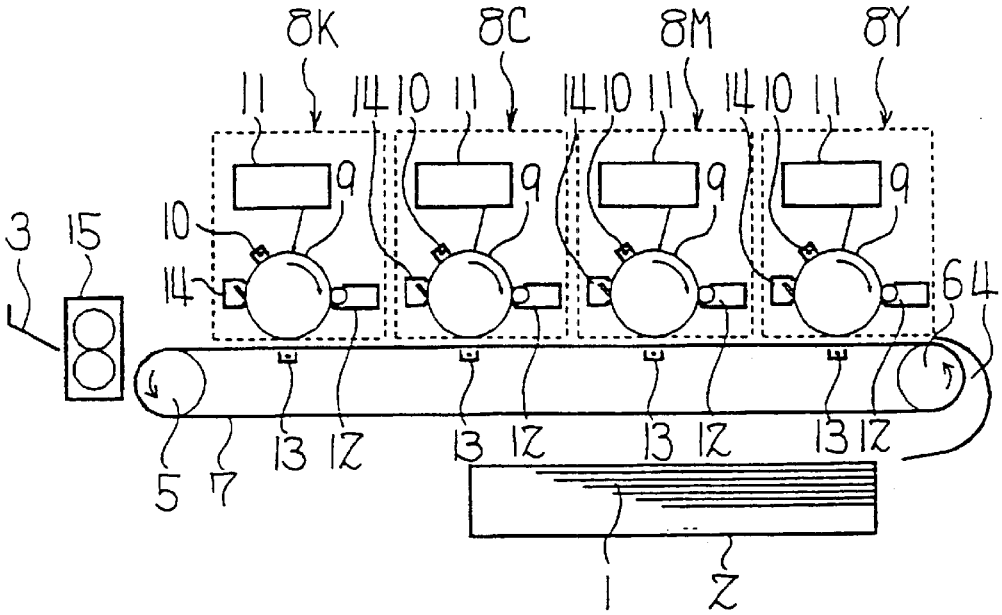
Fig. 1 prior art
FIG. 1 is a side view showing an example of a prior-art color image forming apparatus of a tandem-type method.
Figure 2:
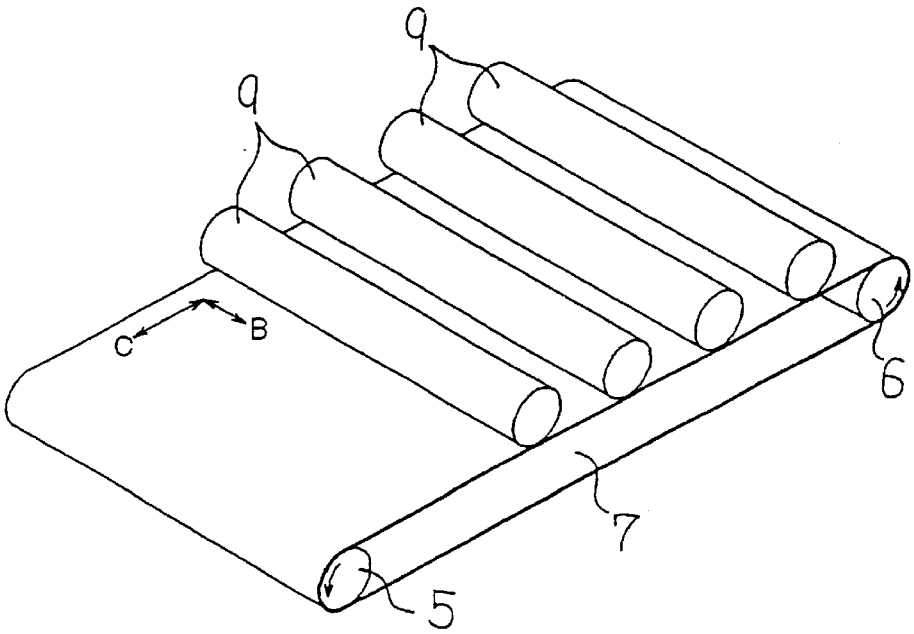
Fig. 2 prior art
FIG. 2 is a perspective view showing a conveying belt and a photoconductive element.
Figure 3:
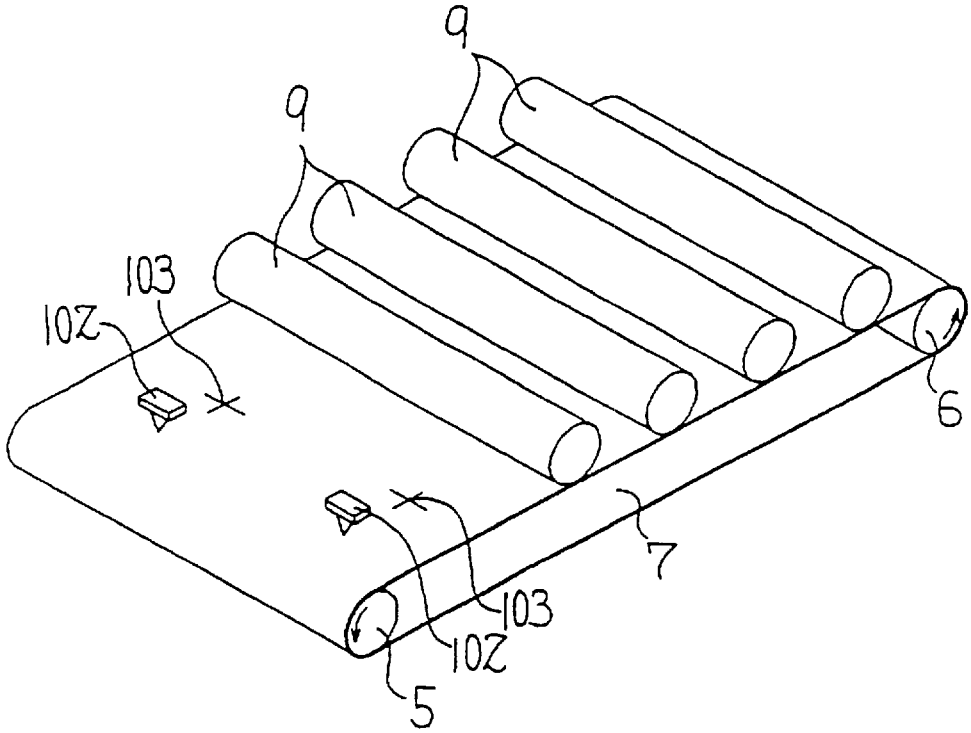
Fig. 3 prior art
FIG. 3 is a perspective view showing the conveying belt, the photoconductive element, and a detecting sensor of a prior-art apparatus for experimenting with a color deviation preventing method.
Figure 4:
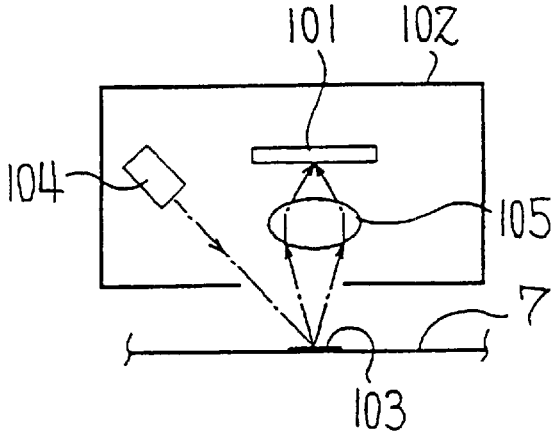
Fig. 4 prior art
FIG. 4 is a vertical sectional side view of the detecting sensor.
Figure 11:
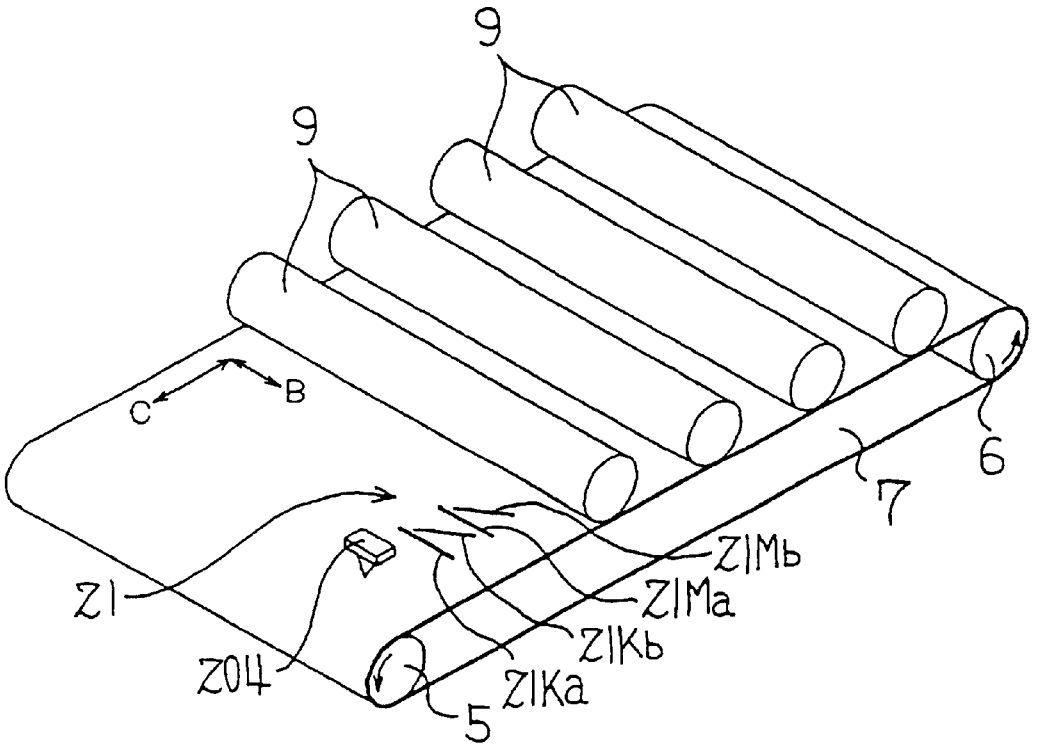
FIG. 11 is a perspective view showing the conveying belt, the photoconductive element, and the detecting device showing a first embodiment of the present invention.
Figure 12:
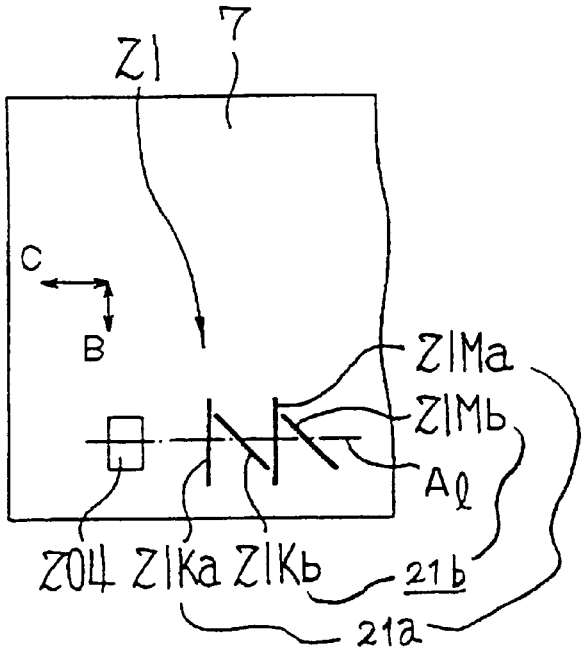
FIG. 12 is a top view showing a positional relation between the detecting device (reflection-type optical sensor) and the image positional deviation detecting mark.
Figure 13:
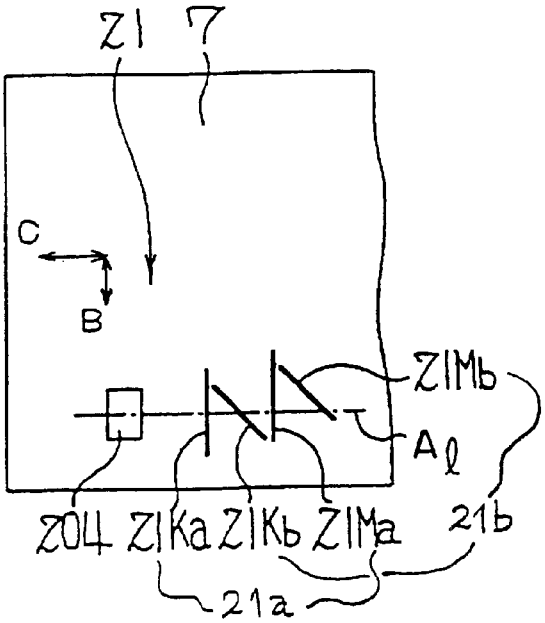
FIG. 13 is a top view illustrating an example occurrence of a color positional deviation with respect to FIG. 12.

In the present embodiment, an apparatus and method for detecting an image positional deviation is shown in FIG. 11 for preventing a color image deviation induced by a positional deviation of respective electrophotographic processing sections with photoconductive elements 9, as shown. As shown in FIG. 11, only one reflection-type optical sensor 204 is disposed on the conveying belt 7 and is used as a detecting device. An image positional deviation detecting mark 21 (hereinafter called a detection mark 21) is formed by the electrophotographic processing section on the conveying belt 7 along an axis $A_l$, as shown before performing an image forming operation. As parts of the detection mark 21, a same pattern of marks of more than two colors including lines 21a (i.e., 21Ka, 21Ma, . . . ) are formed in the main scanning direction B and lines 21*b* are formed at an inclination relative to the respective lines 21*a* (see, e.g., FIGS. 12 and 13). In FIGS. 12 and 13, lines 21Ka and 21Kb are patterns formed with the black electrophotographic processing section 8K (FIG. 1), and lines 21Ma and 21Mb are patterns formed with the magenta electrophotographic processing section 8M (FIG. 1). As the reflection-type optical sensor 204 is the same as that described in FIG. 5, the explanation is omitted.

FIG. 14 is a timing chart showing a signal based on a detecting signal of the reflection-type optical sensor 204. In this timing chart, TK1, TK2, TM1, and TM2 show the respective times when the lines 21Ka, 21Kb, 21Ma, and 21Mb of the detection mark 21 pass by the reflection-type optical sensor 204 respectively. An amount of the color image positional deviation between a standard reference color (black, in this case) and the other color (magenta, in this case) in the main scanning direction B and the sub-scanning direction C is obtained from an ideal interval time T0 (=$S_d$/V) which is calculated from each of the times TK1, TK2, TM1, and TM2 in the timing chart, and a conveying speed V of the detection mark 21 (i.e., the speed of the conveying belt 7), where $S_t$ is a time difference of arrival of respective portions of the image positional deviation detecting mark that corresponds with a lineal distance Sd. An inclination of θ, as shown in FIG. 15*a*, 15*b* for example, corresponds with the angle between line 21*b* and 21*a* of the main scanning direction B.

From this information, an amount of a color image positional deviation E in the main scanning direction B is obtained as follows:

$$E=\{(TM2-TM1)-(TK2-TK1)\}V\cot\theta,$$

or $$E=\{(TM2-TM1)-(TK2-TK1)\}V \qquad \text{(equation 1)}$$

when

θ=45°.

A color image positional deviation F in the sub-scanning direction C is obtained as follows:

$$F=\{(TM1-TK1)-T0\}V \qquad \text{(equation 2.)}$$

Thus, in the present embodiment, the color image positional deviation of the main scanning direction B and the sub-scanning direction C can be detected together with the amount of the color image positional deviation by mounting one inexpensive reflection-type optical sensor.

Figure 16A:
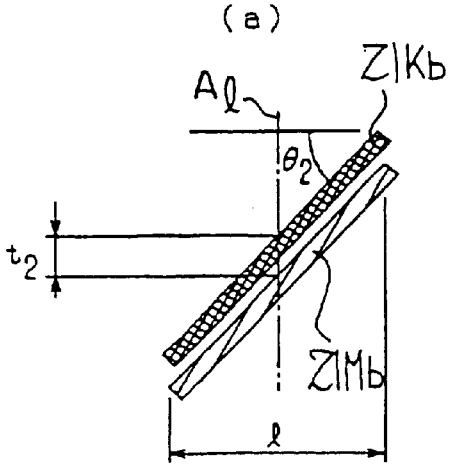
FIGS. 16(*a*) and 16(*b*) are top views showing respective relationships of respective parts of the mark when the slanting angle of the slanting line which composes the image positional deviation detecting mark is at an angle of 45 degrees.
Figure 16B:
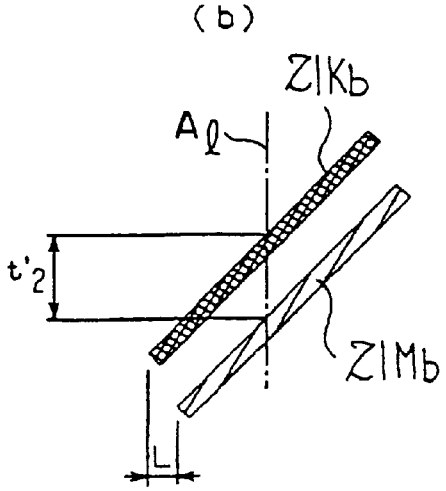
Figure 17A:
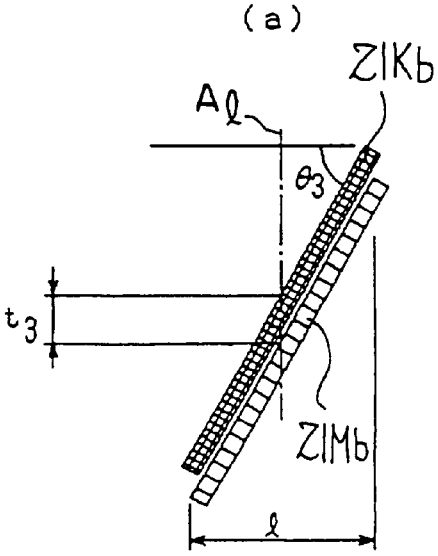
FIGS. 17(*a*) and 17(*b*) are top views showing respective relationships of respective parts of the mark when the slanting angle of the slanting line which composes the image positional deviation detecting mark is relatively large.
Figure 17B:
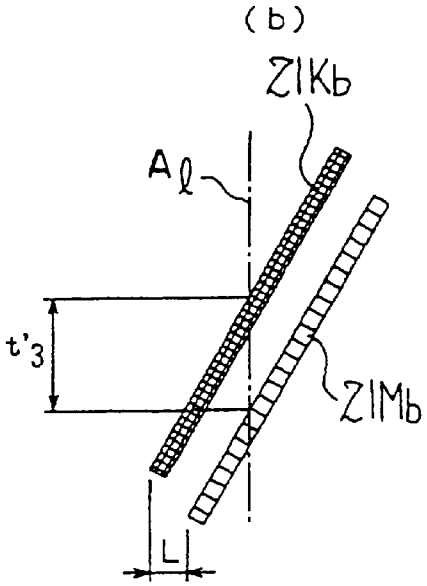

Regarding the detection mark 21, the inclining angle of the line 21*b* that is formed at an inclination angle of 45° relative to the line 21*a* of the main scanning direction B {FIGS. 16(*a*) and 16(*b*)} notice that in FIGS. 15(*b*), 16(*b*) and 17(*b*) the line Z1Mb is offset in the main scanning direction by length L, but there is no such offset in FIGS. 15(*b*), 16(*b*) and 17(*b*). This offset separates lines $ZlK_b$ and $ZlM_b$ along the axis $A_l$, as shown, by the time differences $t_2$ and $t'_2$. The reason why the above structure is adopted is that the larger the inclination angle θ of the line 21*b* becomes (where $\theta_2$ in FIGS. 16(*a*) and 16(*b*) is less than $\theta_3$ in FIGS. 17(*a*) and 17(*b*)), the larger the time difference t and other time difference t' becomes, and thus the color deviation detection accuracy is improved. On the other hand, if the inclination angle θ is set to too large of a value, toner is wasted because the line 21*b* is extended too much in the subscanning direction, in order to have a length l in the main scanning direction {FIGS. 17(*a*), 17(*b*)}. Namely, if the inclining angle $\theta_1$ of the line 21*b* is too small, the time difference $t_1$ and the time difference $t'_1$ become relatively small and the accuracy of the detection deteriorates {FIGS. 15(*a*) and 15(*b*)}. On the other hand, when the inclining angle $\theta_3$ is too large, the time difference $t_3$ and $t'_3$ increases and the accuracy of the detection improves, but toner is wasted because of the extension of the line 21*b* (FIGS. 17*a*, 17*b*).

Figure 18:
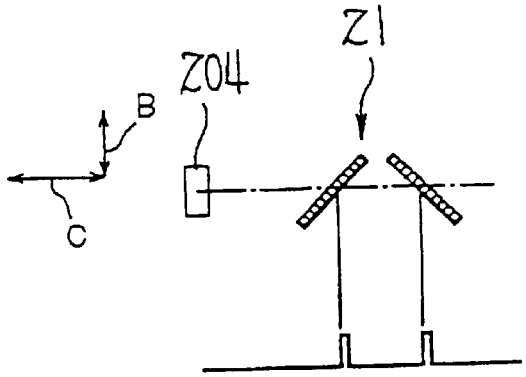
FIG. 18 is a top view showing a variation of the image positional deviation detecting mark.
Figure 19:
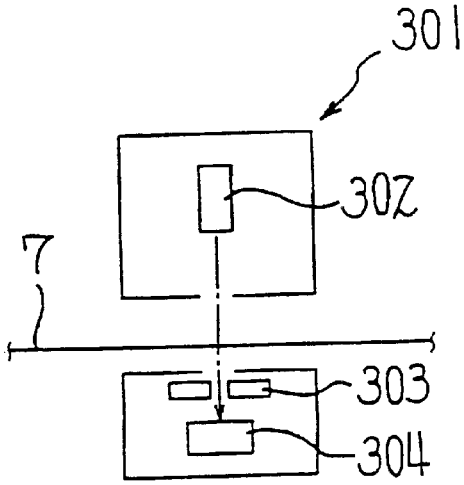
FIG. 19 is a vertical sectional elevation of a transmission-type optical sensor used for a variation detecting device.

FIG. 18 shows a modified detection mark 21, different than the detection mark shown in FIG. 11, that can be detected. The method by which the detection mark 21 of FIG. 18 can be detected by a transmission-type optical sensor, instead of the reflection-type optical sensor 204, is applicable as a modification of the present invention. This transmission-type optical sensor 301 has a construction, as shown in FIG. 19, in which light rays are radiated from the light source 302 onto the conveying belt 7 and transmitted therethrough, and thereafter accepted by the light-accepting element 304 via slit 303. When the transmission-type optical sensor 301 is used, the detection mark 21 formed on the conveying belt 7 is surely detected, and the amount of the color image positional deviation based on the detected result from the detection mark 21 can be detected accurately.

Further, the light-accepting element of the reflection-type optical sensor 204 or the light accepting element 304 of the transmission-type optical sensor 301 may be provided as any one of a single element type or a multiple element type.

Figure 20:
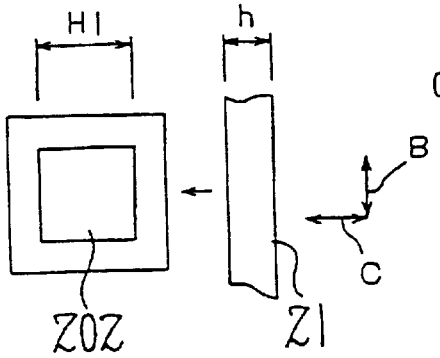
FIGS. 20(*a*) and 20(*b*) are illustrations showing relationships between a width of a slit that is provided in the detecting device (reflection-type optical sensor, for FIG. 20(*a*)) and an output waveform of the detecting device (reflection-type optical sensor, for FIG. 20(*b*)) as a second embodiment of the present invention.
Figure 20B:
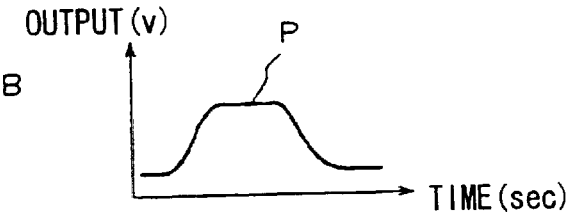

The second embodiment of the present invention is explained in reference to FIGS. 20(*a*) through 23(*b*). Because same reference numerals have been used for common components of the first embodiment, an explanation of these common elements is omitted.

Figure 21A:
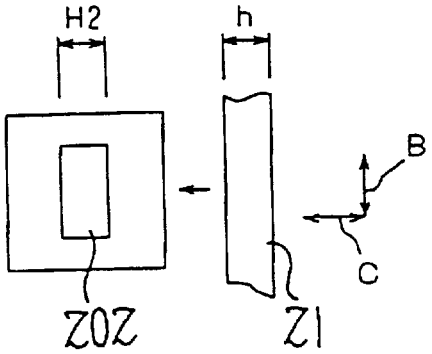
FIGS. 21(*a*) and 21(*b*) are illustrations showing relationships between a width of a slit that is provided in the detecting device (reflection-type optical sensor, for FIG. 21(*a*)) and an output waveform of the detecting device (reflection-type optical sensor, for FIG. 21(*b*)) as a second embodiment of the present invention.
Figure 21B:
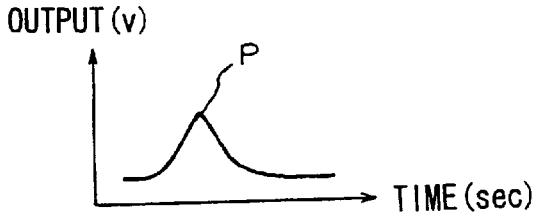
Figure 22A:
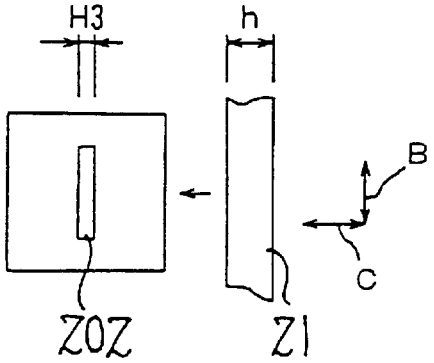
FIGS. 22(*a*) and 22(*b*) are illustrations showing relationships between a width of a slit that is provided in the detecting device (reflection-type optical sensor, for FIG. 22(*a*)} and an output waveform of the detecting device (reflection-type optical sensor, for FIG. 22(*b*)) as a second embodiment of the present invention.
Figure 22B:
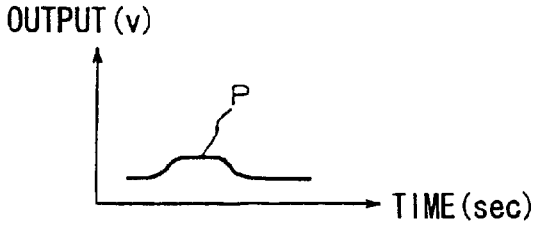
Figure 23A:
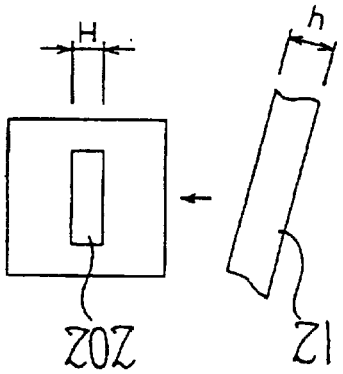
FIGS. 23(*a*) and 23(*b*) are illustrations showing relationships between a width of a slit that is provided in the detecting device (reflection-type optical sensor, for FIG. 23(*a*)} and an output waveform of the detecting device (reflection-type optical sensor, for FIG. 23(*b*)) as a second embodiment of the present invention.
Figure 23B:
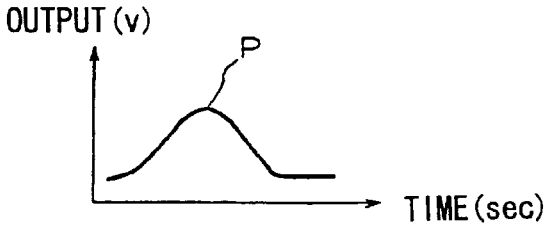

A relationship between a width of the slit 202 which is provided in the reflection-type optical sensor 204 and an output waveform of the reflection-type optical sensor 204 is shown in FIGS. 20(*a*) through 23(*b*) As seen in FIGS. 20(*a*)–23(*a*), a width of a line of the detection mark 21 is indicated with the label "h". FIG. 20(*a*) shows a case in which the slit 202 has the width wider (H1) than that of the detection mark 21 width (H) and in this case, a peak level P at the output waveform of the reflection-type optical sensor 204 becomes flat {FIG. 20(*b*)}. FIG. 21(*a*) shows a case in which the slit 202 has approximately a same width (H2) as that of the detection mark 21, and in this case, a peak level P at the output waveform of the reflection-type optical sensor 204 becomes sharp {FIG. 21(*b*)}. FIG. 22(*a*) shows a case in which the width of the slit 202 (H3) is narrower than that of the detection mark 21, and in this case, a peak level P at the output waveform of the reflection-type optical sensor 204 becomes flat {FIG. 22(*b*)}. Further, FIG. 23(*a*) shows a case in which the slit 202 (width H) is inclined to the detection mark 21, and in this case, a peak level P at the output waveform of the reflection-type optical sensor 204 also becomes somewhat flat {FIG. 23(*b*)}.

In each of these cases, the peak level P of the output waveform of the reflection-type optical sensor 204 has a predetermined pattern and thus by detecting the pattern (or a feature of the pattern) a position of the detection mark 21 may be accurately determined, particularly when the peak level P is as sharp as possible. Therefore, in accordance with FIGS. 20(*a*) through 23(*b*), it is understood that a condition to obtain the highest detection accuracy of the detection mark 21 with the reflection-type optical sensor 204 is that the slit 202 be positioned in parallel with the detection mark 21, and the width thereof be approximately the same as that of the detection mark 21.

Moreover, it is desirable for the slit 202, or a combination of parallel slits, to have a shape(s) being an approximately same width as that of the lines 21*a* and 21*b* of the detection mark 21.

Figure 24:
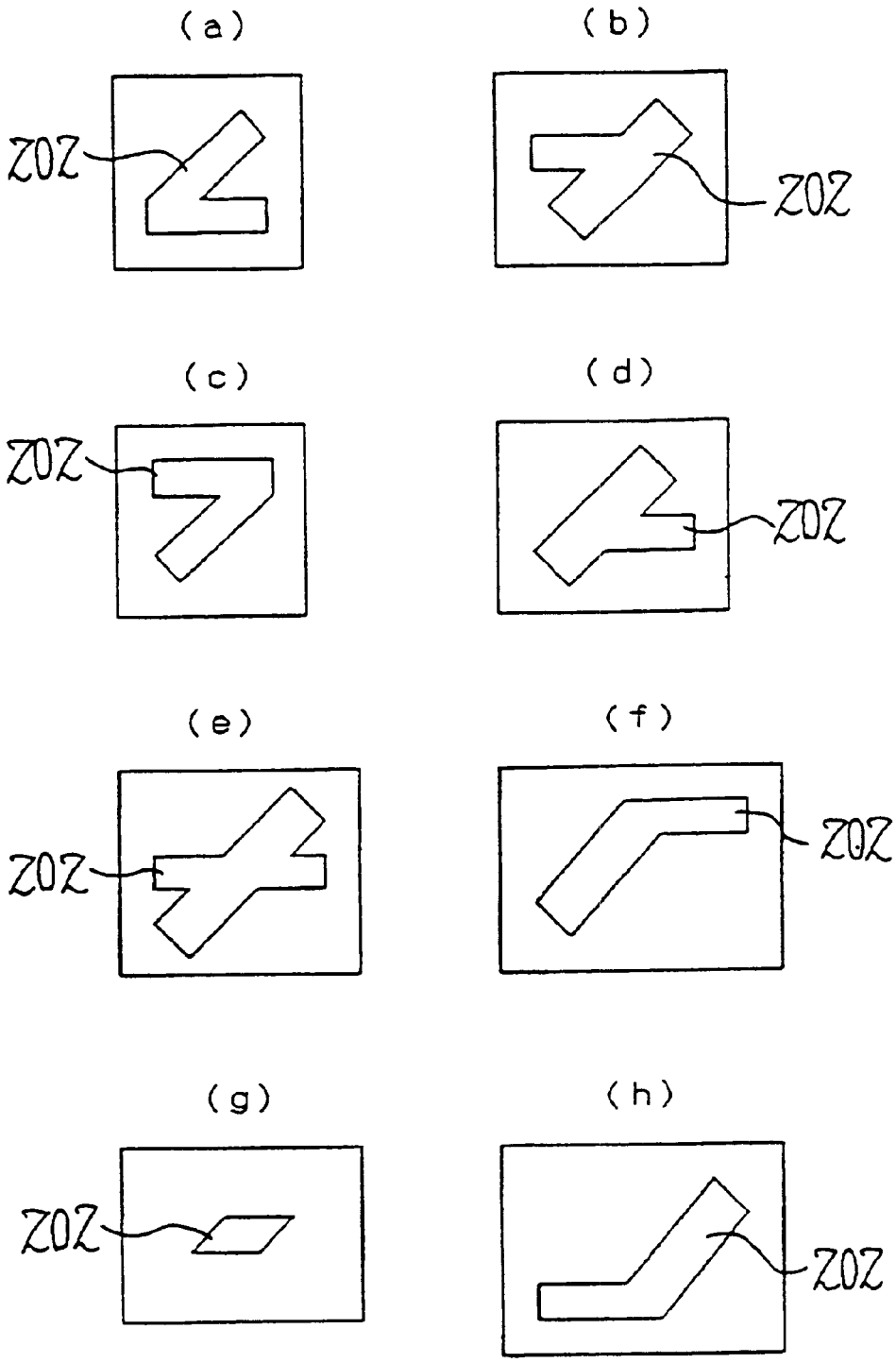
FIG. 24(*a*) through 24(*h*) are top views showing examples of various kinds of shapes of the slit which can be provided in the detecting device (reflection-type optical sensor)

Therefore, various kinds of the slits 202 which are constructed with a combination of segments being parallel with each other and of approximately same width as that of the lines 21*a* and 21*b* of the detection mark 21 are proposed in this embodiment of the present invention. The shapes of the slits 202 are shown in detail in FIGS. 24(*a*) through 24(*h*).

Figure 25:
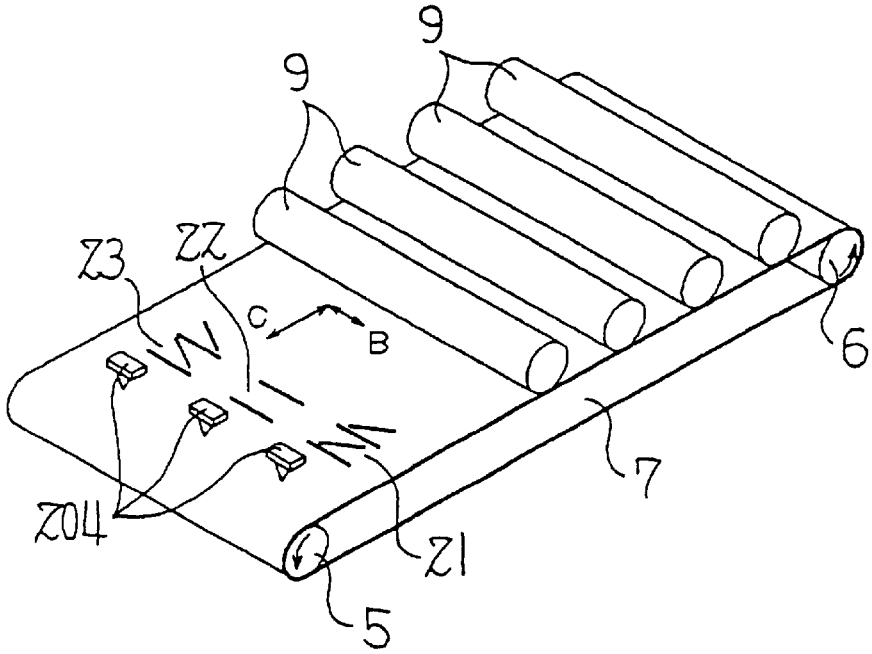
FIG. 25 is a perspective view of the conveying belt, the photoconductive element, and the detecting device (reflection-type optical sensor) showing a third embodiment of the present invention.
Figure 26:
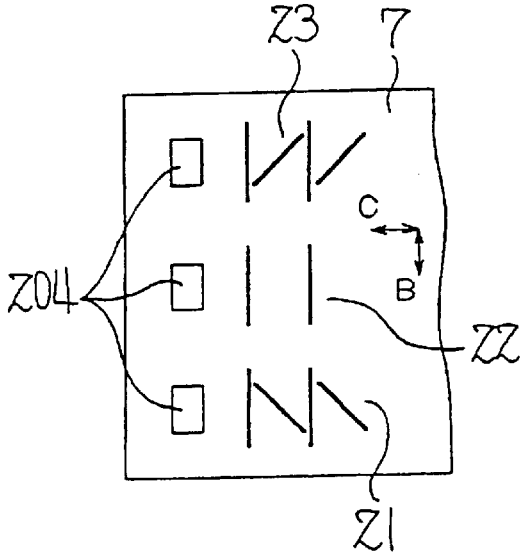
FIG. 26 is a top view showing a positional relationship between the detecting device (reflection-type optical sensor) and the image deviation detecting mark.

The third embodiment of the present invention is explained in reference to FIGS. 25 and 26. In this embodiment, three reflection-type optical sensors 204 are mounted so as to face the conveying belt 7, and three detection marks 21, 22, and 23 are formed to be detected by the sensors 204. A magnification error and an inclination error in a main scanning direction B are detected at the same time.

This application is based on Japanese Patent Application No. 08-306569/1996, filed on Nov. 18, 1996, and Japanese Patent Application No. 09-007746/1997, filed on Jan. 20, 1997, the entire contents of both of which is incorporated herein by reference.

The processes set forth in the present description may be implemented using a conventional general purpose microprocessor programmed according to the teachings of the present specification, as will be appreciated to those skilled in the relevant art(s). Appropriate software coding can readily be prepared by skilled programmers based on the teachings of the present disclosure, as will also be apparent to those skilled in the relevant art(s).

The present invention thus also includes a computer-based product which may be hosted on a storage medium and include instructions which can be used to program a computer to perform a process in accordance with the present invention. The storage medium can include, but is not limited to, any type of disk including floppy disk, optical disk, CD-ROMS, and magneto-optical disks, ROMS, RAMs, EPROMs, EEPROMs, flash memory, magnetic or optical cards, or any type of media suitable for storing electronic instructions.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of forming a color image on a recording sheet, comprising the steps of:

forming more than one color image positional deviation detecting mark having a common pattern along a common axis, comprising, including on a conveying belt a first line of a first detecting mark in a main scanning direction by operating a first electrophotographic processing section disposed at a first position along said conveying belt, and including a second line of the first detecting mark on said conveying belt positioned at an inclined angle with respect to said first line, including a second detecting mark on said conveying belt by operating a second electrophotographic processing section disposed at a second position along said common axis, said second detecting mark also including a first line and a second line at an inclined angle with respect to said first line; and detecting said first line and said second line of said first detecting mark and detecting said first line and said second line of said second detecting mark with a single detecting device having a light source, a slit, and a light accepting element, and determining a positional deviation, in the main scanning direction and a subscanning direction, of images formed on said recording sheet by said first electrophotographic processing section and said second electrophotographic processing section based on a conveying speed of said conveying belt, a timing of an interval from when said single detecting device detects said first line and said second line of said first detecting mark, and a timing of an interval from when said single detecting device detects said first line and said second line of said second detecting mark.

2. The method of claim 1, further comprising the steps of:

transferring a first color image of said images to said recording sheet from said first electrophotographic processing section; and transferring a second color image of said images to said recording sheet after said first electrophotographic processing section transfers said first color image, comprising, superimposing the second color image on the first color image.

3. The method of claim 1, wherein said detecting step comprises detecting said first line and said second line with said single detecting device wherein said slit comprises a combination of slits arranged parallel to one another and provided at an approximately same width as that of said image positional deviation detecting marks.

4. A color image forming apparatus, comprising:

a conveying belt on which a single recording sheet is conveyed;

a plurality of electrophotographic processing sections positioned along a moving direction of said conveying belt, each of the electrophotographic processing sections configured to form and transfer a different colored image onto the single recording sheet by transferring the images, said different colored images being superimposed on one another on each single recording sheet; and a detector comprising a light source, a slit, and a light accepting element, wherein at least two of said electrophotographic processing sections being configured to form on said conveying belt at least two image positional deviation detecting marks of at least two colors in a same pattern, each image positional deviation detecting mark comprising, a first line in a main scanning direction, and a second line positioned at an inclined angle with respect to said first line, said light source of said detector successively illuminating each image positional deviation detecting mark, and light from said light source being passed through said slit and to said light accepting element where the light is detected after having been exposed to each image positional deviation detecting mark, said detector configured to detect a positional detection of images, in the main scanning direction and a subscanning direction, formed on a recording sheet from a conveying speed of said conveying belt and respective times of an interval between said detector detecting said first line and said second line of each image positional deviation detecting mark.

5. The color image forming apparatus of claim 4, wherein said slit comprises a combination of slits arranged parallel to one another and spaced at approximately a same width as a width of at least one of said first line and said second line of each image positional deviation detecting mark.

6. An apparatus for forming a color image on a recording sheet, comprising:

conveying means for conveying the recording sheet;

means for forming at least two color image positional deviation detecting marks having a common pattern, including means for including a first line of a first mark on said conveying means in a main scanning direction by operating a first electrophotographic processing means disposed at a first position along said conveying means, means for including a second line of said first mark on said conveying means positioned at an inclined angle with respect to said first line, means for including a second mark having a first line and a second line aligned with said first line and said second line of said first mark on a common axis by operating a second electrophotographic processing means disposed at a second position along said conveying means;

means for detecting said first line and said second line of said second mark and said first line and said second line of said first mark with a single detecting means comprising, means for illuminating at least one of said first line and said second line of said first and second marks with light, which interacts with at least one of said first line and said second line of said first and second marks, and means for passing said light to said means for detecting, means for detecting a positional deviation of images, in the main scanning direction and a subscanning direction, formed on a recording sheet section from a conveying speed of said conveying means and respective times of an interval between said single detecting means detecting said first line and said second line of each of said first mark and said second mark.

7. The apparatus of claim 6, further comprising:

means for transferring a first color image of a set of color images to said recording sheet from said first electrophotographic processing means; and means for transferring a second color image of said set of color images to said recording sheet after said first electrophotographic processing means transfers said first color image, comprising, means for superimposing the second color image on the first color image.

8. The apparatus of claim 6, wherein said single detecting means comprises means for detecting said first line and said second line with said single detecting means, and wherein said means for passing comprises sets of slits wherein each set of slits being arranged parallel to one another and provided at an approximately same width as that of each image positional deviation detecting mark.

* * * * *